US005499401A

United States Patent [19]

Heinmiller

[11] Patent Number: 5,499,401

[45] Date of Patent: Mar. 19, 1996

[54] INSULATED HAND WARMER WITH A COLLAPSIBLE WALL AND RETAINING MEANS

[76] Inventor: Helen Heinmiller, 43503 Plantation Ter., Ashburn, Va. 22011

[21] Appl. No.: 409,163

[22] Filed: Mar. 23, 1995

[51] Int. Cl.[6] ..... A41D 13/08

[52] U.S. Cl. ..... 2/208; 2/66; 2/91

[58] Field of Search ..... 2/91, 208, 16, 2/66; 224/224

[56] References Cited

U.S. PATENT DOCUMENTS

| | | | |
|---|---|---|---|
| D. 310,942 | 10/1990 | Woodall . | |
| 384,503 | 6/1888 | Brahadi | 2/66 |
| 2,014,256 | 9/1935 | Kramer | 2/66 |
| 2,086,326 | 7/1937 | Goldberg | 2/66 |
| 2,557,280 | 6/1951 | Hahn | 2/66 |
| 2,727,241 | 12/1955 | Smith | 2/66 |
| 3,793,643 | 2/1974 | Kinoshita | 2/66 |
| 4,174,793 | 11/1979 | Wisowaty . | |
| 4,408,355 | 10/1983 | Brock | 2/66 |
| 4,495,659 | 1/1985 | Madnick et al. | 2/66 |
| 4,515,300 | 5/1985 | Cohen . | |
| 4,586,506 | 5/1986 | Nangle . | |
| 4,796,790 | 1/1989 | Hamilton . | |
| 4,862,519 | 9/1989 | Bull | 2/66 |
| 4,893,357 | 1/1990 | Evans | 2/208 |
| 4,949,887 | 8/1990 | Holmes . | |
| 5,048,734 | 9/1991 | Long . | |
| 5,135,144 | 8/1992 | Blakely et al. . | |
| 5,139,187 | 8/1992 | Fowler | 2/66 X |
| 5,241,706 | 9/1993 | Netz | 2/91 X |
| 5,269,023 | 12/1993 | Ross | 2/66 |
| 5,294,030 | 3/1994 | Jollivette . | |

*Primary Examiner*—C. D. Crowder
*Assistant Examiner*—Shirra L. Jenkins
*Attorney, Agent, or Firm*—Daniel R. Gropper

[57] ABSTRACT

An insulated hand warmer adapted to be attached to the user's waist by a belt apparatus. The insulated hand warmer has a front wall, a top wall, a back wall, a bottom wall and a collapsible wall, and a plurality of adjustment straps. The hand warmer can be compressed against the user's body by the adjustment straps when not in use. The insulated hand warmer also features a central pocket wherein a heat source can be placed. The user's hands are inserted from each end of the insulated hand warmer to come into contact with the heat source. A front pocket for storage of the user's travel articles is also taught herein.

22 Claims, 4 Drawing Sheets

INSULATED HAND WARMER WITH A COLLAPSIBLE WALL AND RETAINING MEANS

BACKGROUND OF THE INVENTION

Numerous devices have been taught which are supported by a belt-type of apparatus from a user's waist which support insulated containers.

For example, U.S. Pat. No. 4,949,887, to Holmes, for Insulated Multi-use Seat Cushion with Closeable Hand and Foot Openings teaches an insulated hollow cushion having a neck strap and an interior portion sufficiently large to accommodate a portable heating source and/or hot and cold foods. This patent also teaches two side slits, through which hands can be inserted for warmth and sealable flaps for closing the side slits when desired. Also taught are the following elements: a slit at the top of the cushion for insertion of items into the cushion's interior; a closeable top large flap to seal the top opening; and a closeable top small flap to insulate the gap between the user's ankles when a user's feet are inserted through the top slit. This patent does not teach an insulated hand warmer adaptable to be worn around the waist of the user with a collapsible wall whereby the insulated hand warmer can be collapsed into itself to be out of the user's way while being worn but not used. This patent also does not teach the use of a central pocket around which the hands of the user may be placed to receive heat energy from the heat source.

U.S. Pat No. 4,515,300, to Cohen, teaches a Multiple Use Sports Bag and Method of Converting it into a Backpack. This patent does not teach an insulated hand warmer worn around the waist of the user which is collapsible into itself.

U.S. Pat. No. 4,586,506, to Nangle, teaches an Elastic Wrap with a Flexible Wall Container in which a heat or a cold pack is secured to one's body through use of a reclosable elastic wrap.

U.S. Pat. No. 4,796,790, to Hamilton, teaches a Medical Supply Case for organizing and holding various small medical supplies to be worn and/or carried by medical personnel. Although hung from a belt and containing a pocket, it does not teach an insulated collapsible hand warmer.

U.S Pat. No. 5,048,734, to Long, teaches an Insulated Container Jacket to keep a beverage warm or cold which is attached to a user's belt.

U.S. Pat. No. 5,135,144 to Blakeley et al., teaches an Insulated Drug Supply Pouch worn on a belt which is adapted to hold a supply of drug containers at stable temperatures and in a contamination resistant environment. Although this invention is insulated and collapsible, and has an internal pocket for a heating element, it does not teach an insulated hand warmer which is suspended from the user's waist.

OBJECT AND ADVANTAGES

It is an object of the present invention to teach an insulated hand warmer which is suspended from a user's waist which is collapsible to and out of the way when not in use.

Another object of the present invention is to teach an insulated hand warmer with a central pocket for holding a heating device around which the hands of the user may be placed, Another object of the present invention is to teach a recloseable and length adjustable belt for securing the insulated hand warmer to the user's body, Another object of the present invention is to teach an insulated hand warmer with a front pocket for storage of a user's personal items.

DESCRIPTION OF THE PREFERRED EMBODIMENT

Figure 1:
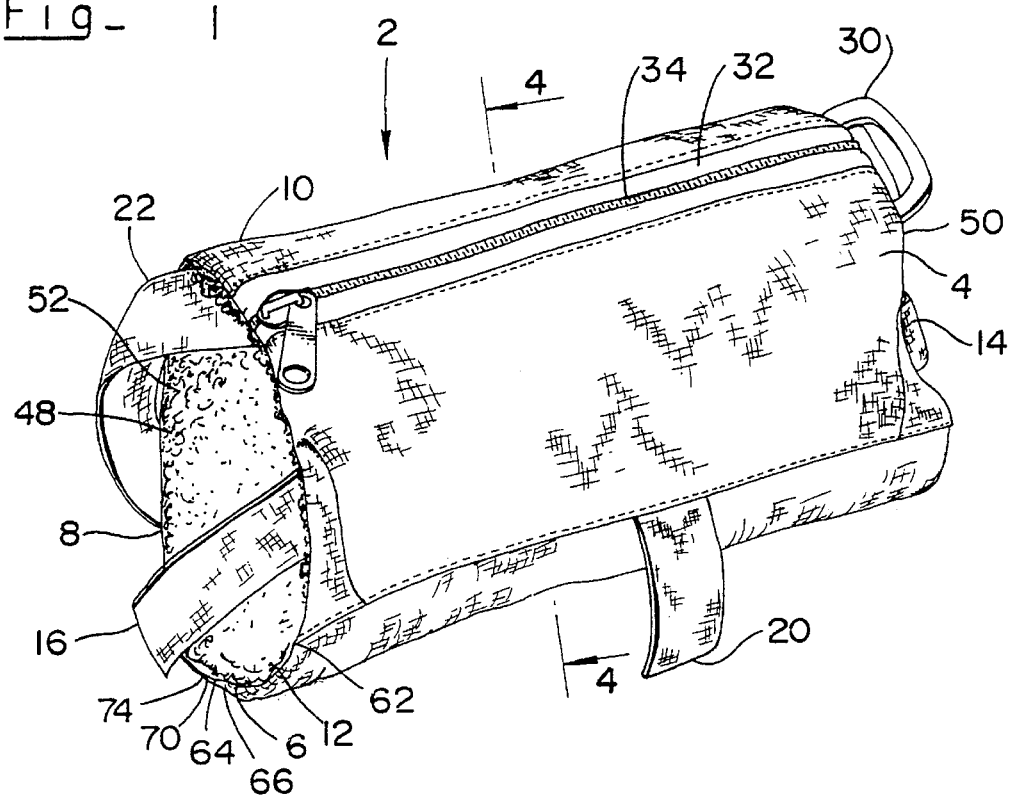
FIG. 1 is a perspective view of the insulated hand warmer in the open position.
Figure 2:
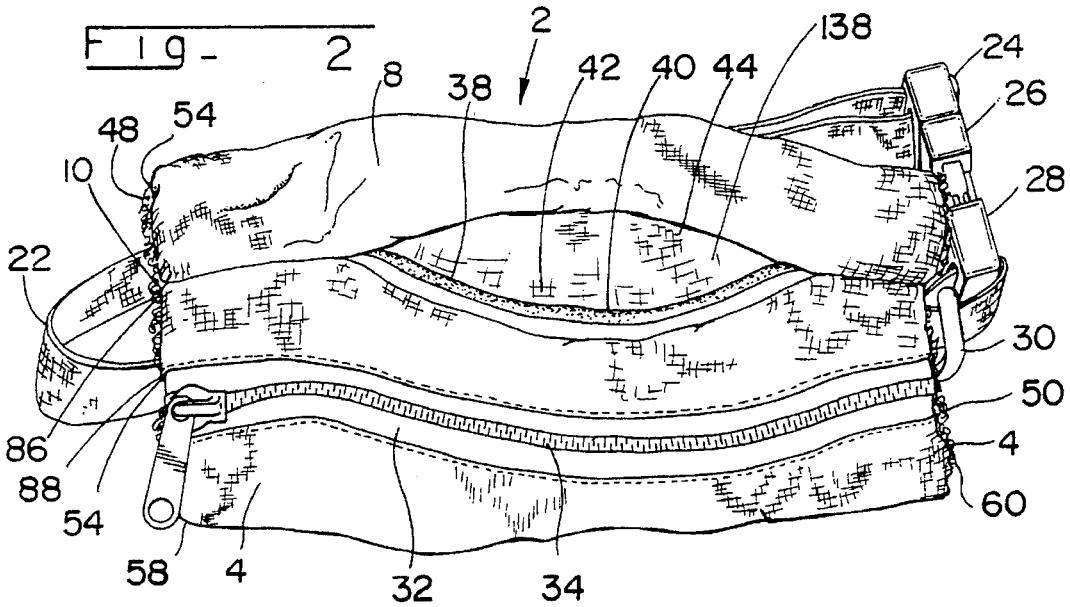
FIG. 2 is a perspective top view of the insulated hand warmer showing the central pocket in the open position and the front pocket in the closed position.

Referring to FIGS. 1,2,3,4,5 and 6, the insulated hand warmer is generally designated 2. Insulated hand warmer 2 has front wall 4, bottom wall 6, back wall 8, top wall 10, and collapsible section 12. Front wall 4 has first edge 54, second edge 56, and first end 58, and second end 60. Collapsible section 12 has first edge 62, second edge 64, first end 66, and second end 68. Bottom wall 6 has first edge 70, second edge 72, first end 74, and second end 76. Back wall 8 has first edge 78, second edge 80, first end 82, and second end 84. Top wall 10 has first edge 86, second edge 88, first end 90, and second end 92. Front wall 4 has outer face 94 and inner face 96. Collapsible section 12 has outer face 98 and inner face 100. Bottom wall 6 has outer face 102 and inner face 104. Back wall 8 has outer face 106 and inner face 108. Top wall 10 has outer face 110 and inner wall face.

Second edge of front wall 56 is connected to first edge of collapsible wall 62. Second edge of collapsible wall 64 is connected to first edge of bottom wall 70. Second edge of bottom wall 72 is connected to first edge of back wall 78. Second edge of back wall 80 is connected to first edge of top wall 86. Second edge of top wall 88 is connected to first edge of front wall 54. Respective first and second edges of front wall 4, collapsible wall 12, bottom wall 6, back wall 8, and top wall 10 are joined to form a unitary device where the respective edges are continuous and the respective ends form left hand opening 50 and right hand opening 48 in insulated hand warmer 2.

Figure 3:
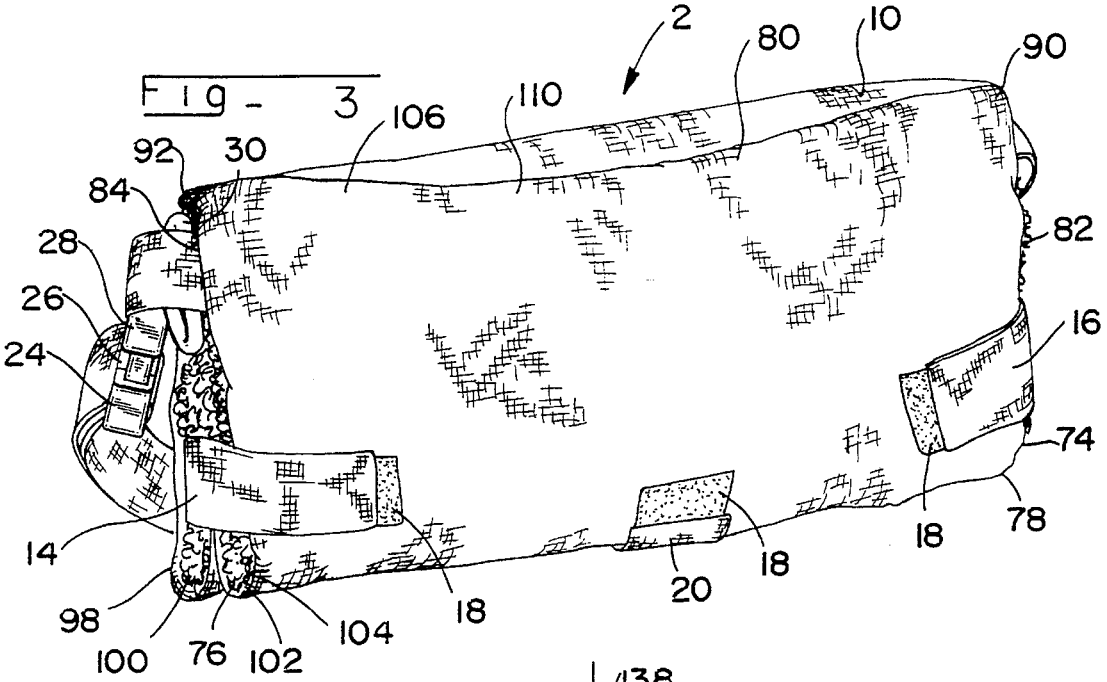
FIG. 3 is a rear perspective view of the insulated hand warmer showing the adjustable tabs and the collapsible wall in the closed position.
Figure 4:
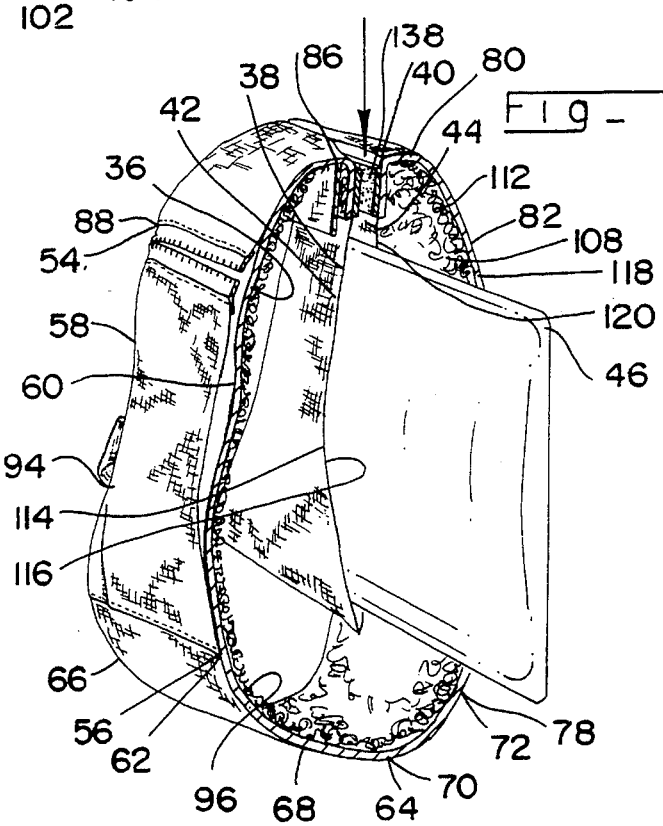
FIG. 4 is a cross sectional end view of the insulated hand warmer showing the cut away view of the central pocket for reception of the heating element and the insulation along the inside walls of the insulated hand warmer.
Figure 5:
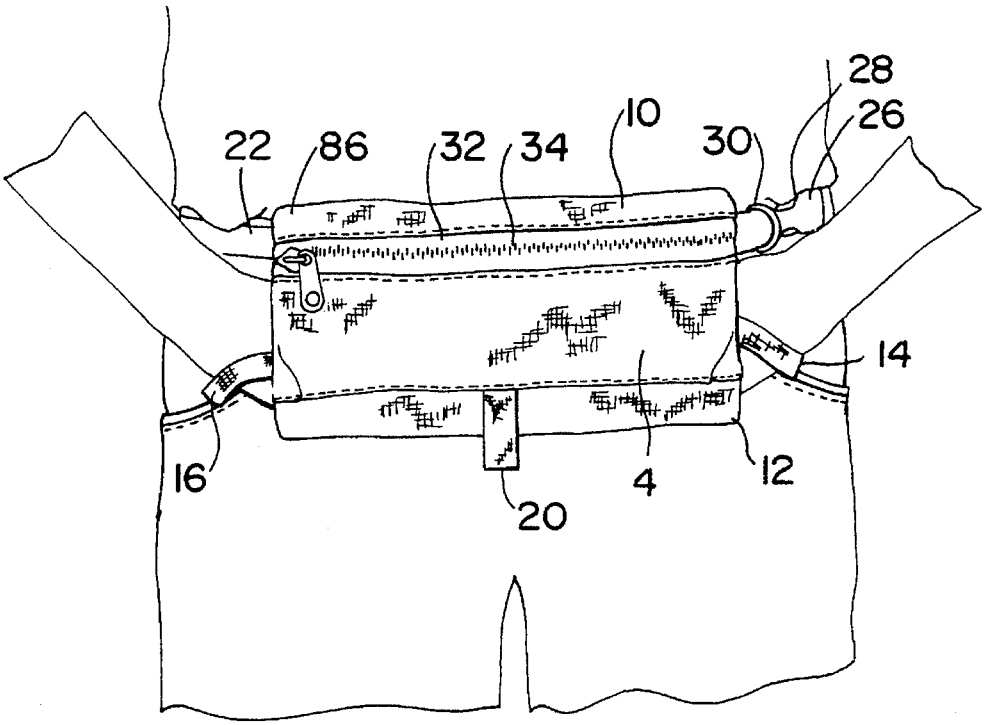
FIG. 5 is a front elevational view of the insulated hand warmer in use attached to the belt of the user with the tabs in the open position.
Figure 6:
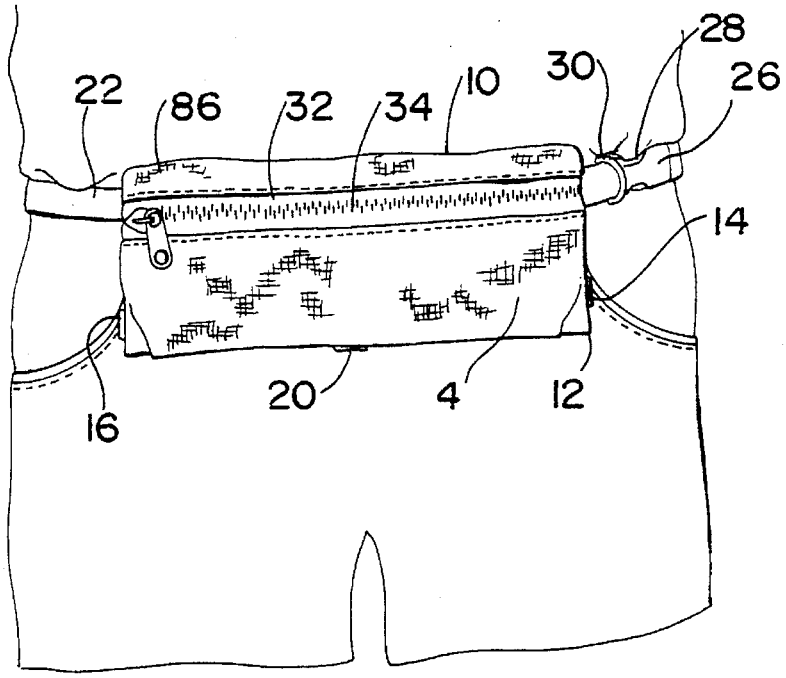
FIG. 6 is a front elevational view of the insulated hand warmer with the tabs in the closed position and the insulated hand warmer in the closed position.
Figure 7:
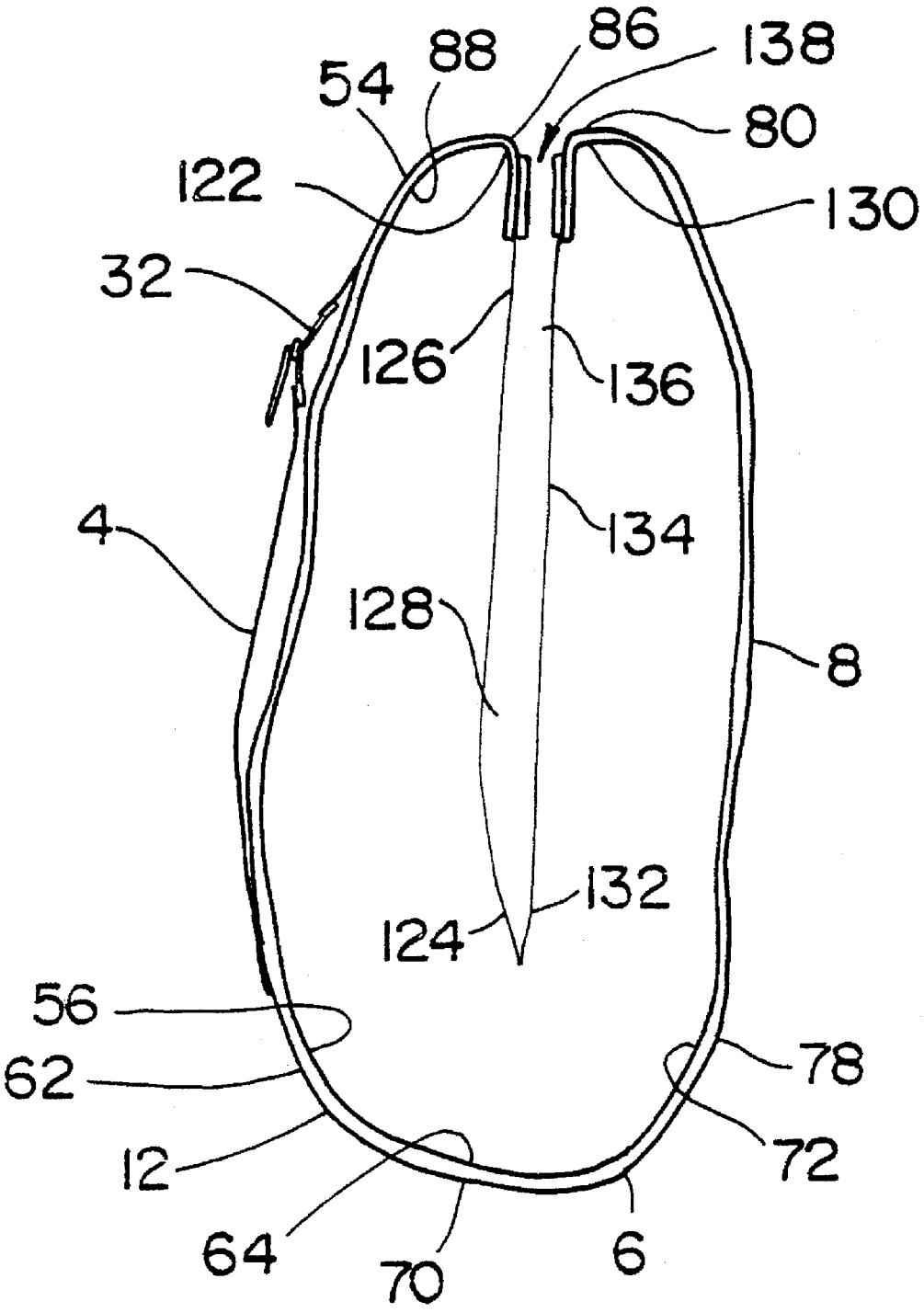
FIG. 7 is a side elevational view of the insulated hand warmer showing the connection points of the front, collapsible, bottom, back and top walls of the insulated hand warmer, respectively.

A number of closeable tabs 14, 16 and 20 are disposed about insulated hand warmer 2 for alternately maintaining insulated hand warmer 2 in an open position, as shown in FIGS. 1, 2, 4, and 5 or in a closed position, as shown in FIGS. 3 and 6. Tabs 14, 16 and 20, and the tab engaging pads 18 may be formed of any material now known or hereinafter developed which is readily recloseable and maintains a firm connection when engaged.

Referring to FIGS. 1, 3, and 5, left side tab is designated 14, right side tab is designated 16, front tab is designated 20, and tab engaging pads are designated 18. Numerous recloseable tabs and tab engaging pads may be placed on insulated hand warmer 2 as needed.

Insulated hand warmer 2 is releasably attached to the user's torso by means of belt 22. Belt 22 may be adjustable through belt size adjustment 24 and may be recloseable through belt closing plug 26 and belt closing receptacle 28. Belt 22 and belt closing plug 26 and belt closing receptacle 28 may be of any material now known or hereinafter developed which functions to adjustably and securely attach insulated hand warmer 2 to a user's torso. Belt ring 30 may be added to insulated hand warmer 2 for easy attachment of belt 22 to insulated hand warmer 22 and/or for the attachment of other items to insulated hand warmer 2, such as key chains, thermometers, etc., for the user's needs and convenience.

Central pocket 38 may be formed from any material now known or hereinafter developed which will permit heat from heat source 46 to pass through central pocket front wall 42 and central pocket back wall 44 so as to permit heat transfer to the hands of the user of insulated hand warmer 2.

Central pocket closure means 40 is configured in the access port of central pocket 38. Central pocket aperture 138 is disposed between second edge of back wall 80 and first edge of top wall 86. The width of central pocket 38 is limited by connected first and second ends of top wall 90 and 92, respectively, and first and second ends of back wall 82 and 84, respectively. Central pocket front wall 42 has outer face 114 and inner face 116. Central pocket back wall 44 has outer face 118 and inner face 120. Central pocket front wall 42 has first edge 122, second edge 124, first end 126, and second end 128. Central pocket back wall 44 has first edge 130, second edge 132, first end 134, and second end 136.

First edge of top wall 86 is connected to first edge of central pocket front wall 122 and second edge of back wall 80 is connected to first edge of central pocket back wall 130, thereby forming central pocket aperture between first edge of top wall 86 and second edge of back wall 80.

Central pocket closure 40 can be of made from any closeable means now known or hereinafter developed, including hook and loop type fasteners such as Velcro brand fasteners or zipper. The means for closing is best connected to first edge of top wall 86 and second edge of back wall 80.

Central pocket 38 should be adapted for removably receiving and supporting heat source 46.

Front pocket 32 may be formed between outer face of front wall 94 and inner face of front wall 96. Front pocket 32 should a recloseable means in communication with front pocket 32 and an aperture through outer front wall 94 of insulated hand warmer 2. Such recloseable means can include, zipper, button, or hook and loop type fasteners such as Velcro brand fasteners, or any method now known or hereinafter developed, as designated generally by 34. The inner wall of front pocket 32 is generally designated as 36 in FIG. 4.

Insulated materials such as fleece, down, wool or other insulating materials, which are flexible and resilient can be placed on the inner faces of front wall 96, collapsible wall 100, bottom wall 104, back wall 108, and top wall 112. Such internal wall insulation is generally designated 52 in FIG. 4. Such materials should be easy to clean and dry and should be rugged and durable.

Heat source 46 may be of any now known or hereinafter developed source of heat, including heat formed through chemical action or microwave action. Such inexpensive heating units are currently available. Additionally, the heating units should preferably be reusable so as to be more economically and environmentally sound.

The walls of insulated hand warmer 2 should be made of a strong, durable, resilient, flexible, non-water resistant or water resistant material. Heavy denier nylon is especially well suited for these purposes.

In use, a the user will place insulated hand warmer around his or her waist through use of adjustable belt 22. A reusable heat source 46 may be placed in central pocket 38. When not in use by the user, collapsible section 12 is held in the collapsed position against the user's torso by means of left side tab 14, right side tab 16, and front tab 20 being engaged with tab engaging pad 18 thereby compressing collapsible section 12 and bringing front wall 4 into contact with back wall 8. When in use, if the user's hands are too large to be placed within right hand opening 48 and left hand opening 50 with tabs 14, 16, 20 engaged, the user may disengage tabs 14, 16, and 20 and expand right hand opening 48 and left hand opening 58 and insert his or her hands in openings 48 and 50.

Front pocket 32 may be used to store items which the user needs to be readily available. Belt 22 is adjustable through belt adjustment 24, and also is releasable through belt closing plug 26 and belt closing receptacle 28. This enables the user of insulated hand warmer 2 to quickly take on or take off insulated hand warmer 2 while retaining the size of belt 22.

It will be apparent that numerous modifications of the above invention may be made without departing from the nature, intent, or spirit of the invention as claimed herein.

I claim is:

1. A hand warmer comprising:

a front wall, said front wall having an outer face and an inner face and a first edge and a second edge and a first end and a second end;

a collapsible wall, said collapsible wall having an outer face and an inner face and a first edge and a second edge and a first end and a second end, wherein said second edge of said front wall is connected to said first edge of said collapsible wall;

a bottom wall, said bottom wall having an outer face and an inner face and a first edge and a second edge and a first end and a second end, wherein said second edge of said collapsible wall is connected to said first edge of said bottom wall;

a back wall, said back wall having an outer face and an inner face and a first edge and a second edge and a first end and a second end, wherein said second edge of said bottom wall is connected to said first edge of said back wall;

a top wall, said top wall having an outer face and an inner face and a first edge and a second edge and a first end and a second end, wherein said second edge of said back wall is connected to said first edge of said top wall and wherein said second edge of said top wall is connected to said first edge of said front wall; and, at least one closing means connected to said front wall for maintaining said collapsible wall in a collapsed condition.

2. A hand warmer, as recited in claim 1, further comprising an opening formed between said second edge of said back wall and said first edge of said top wall, said opening being limited by said first and second connected ends of said top wall and said back wall.

3. A hand warmer, as recited in claim 2, further comprising a central pocket, said central pocket having a front wall,, said front wall of said central pocket having an outside face, and inside face, a first edge and a second edge and a first end and a second end;

said central pocket having a rear wall, said rear wall of said central pocket having an outside face, and inside face, a first edge and a second edge and a first end and a second end;

wherein, said first ends and said second ends of said front wall and said rear wall of said central pocket are connected;

wherein, said first edges of said front wall and said rear wall of said central pocket are connected;

wherein, said second edge of said front wall of said central pocket is connected to said first edge of said top wall and said second edge of said back wall of said central pocket is connected to said second edge of said back wall;

wherein, said opening between said first edge of said top wall and said second edge of said back wall is in communication with said inside faces of said front wall and said rear wall of said central pocket.

4. A hand warmer, as recited in claim 3, further comprising means for closing said opening between said first edge of said top wall and said second edge of said back wall.

5. A hand warmer, as recited in claim 1, wherein said closing heating means disposed in said central pocket.

6. A hand warmer, as recited in claim 5, wherein said heating means is removably disposed in said central pocket.

7. A hand warmer, as recited in claim 5, wherein said heating means is reusable.

8. A hand warmer, as recited in claim 5, wherein said heating means is by chemical reaction.

9. A hand warmer, as recited in claim 5, wherein said heating means is by microwave energy reaction.

10. A hand warmer, as recited in claim 1, further comprising means for removably supporting said hand warmer from the waist of a user.

11. A hand warmer, as recited in claim 10, wherein means for removably supporting said hand warmer from the waist of a user is a belt.

12. A hand warmer, as recited in claim 11, wherein the length of said belt is adjustable.

13. A hand warmer, as recited in claim 11, further comprising a ring connected to said belt.

14. A hand warmer, as recited in claim 1, further comprising a front pocket disposed between said inner face and said outer face of said front wall.

15. A hand warmer, as recited in claim 14, further comprising means for closing said front pocket.

16. A hand warmer, as recited in claim 1, further comprising insulating means disposed on said inside faces of said top, back, bottom, collapsible and front walls of said hand warmer.

17. A hand warmer, as recited in claim 16, wherein said insulating material is fleece.

18. A hand warmer, as recited in claim 1, wherein said closing means is a hook and loop fastener.

19. A hand warmer, as recited in claim 1, wherein said front, top, back, bottom and collapsible walls are made of a durable, water resistant material.

20. A hand warmer, as recited in claim 19, wherein said front top, back, bottom and collapsible walls are made of nylon.

21. A hand warmer, as recited in claim 1, further comprising multiple closing means, connected to said front wall, for maintaining said collapsible wall in a collapsed condition.

22. A hand warmer, as recited in claim 1, wherein said front, top, back, bottom and collapsible walls are made of a durable, non water resistant material.

* * * * *